US007382252B2

(12) United States Patent
Brannon

(10) Patent No.: US 7,382,252 B2
(45) Date of Patent: Jun. 3, 2008

(54) MAILBOX SUPPORT WITH LIGHTED RESIDENCE IDENTIFICATION AND ALERT SIGNAL APPARATUS

(76) Inventor: Chet J. Brannon, 119 Wilborn Cir., Simpsonville, SC (US) 29681

( * ) Notice: Subject to any disclaimer, the term of this patent is extended or adjusted under 35 U.S.C. 154(b) by 231 days.

(21) Appl. No.: 11/406,475

(22) Filed: Apr. 18, 2006

(65) Prior Publication Data

US 2007/0241922 A1 Oct. 18, 2007

(51) Int. Cl.
*G08B 13/14* (2006.01)

(52) U.S. Cl. ..... 340/569; 340/539.14; 340/691.1; 340/332; 40/566; 40/541; 232/19; 232/34; 362/154; 362/431

(58) Field of Classification Search ..... 340/539.14, 340/332, 691.1, 569, 331, 333, 328, 326, 340/286.01, 540, 539.1, 693.2, 543, 815.4; 40/566, 568, 541, 544, 564, 465; 232/17, 232/19, 34, 36, 35, 45; 362/154, 155, 251, 362/253, 249, 431
See application file for complete search history.

(56) References Cited

U.S. PATENT DOCUMENTS 4,853,593 A 8/1989 Stein ..... 313/500
4,868,543 A 9/1989 Binkley ..... 340/569
5,143,285 A * 9/1992 Wise ..... 232/39
5,155,470 A * 10/1992 Tuttle ..... 340/539.1
5,573,178 A * 11/1996 Worden ..... 232/24
6,017,131 A * 1/2000 Goins ..... 362/249
6,050,012 A * 4/2000 Greenfield ..... 40/564
6,513,706 B1 2/2003 Kuca ..... 232/35
6,525,700 B1 2/2003 Smith ..... 345/34
6,601,968 B2 8/2003 Voacolo ..... 362/154
6,666,372 B1 12/2003 Nagel ..... 232/45
6,739,732 B2 5/2004 Tseng ..... 362/183
6,799,716 B1 10/2004 Kuelbs ..... 232/39
2004/0083634 A1 * 5/2004 Blsson et al. ..... 40/566

* cited by examiner

*Primary Examiner*—Brent A. Swarthout
(74) *Attorney, Agent, or Firm*—Charles L. Schwab; Nexsen Pruet, LLC

(57) ABSTRACT

An emergency signal apparatus for alerting police, medical service, neighbors and people passing by to emergency situations that may arise in or at a residence. The apparatus is designed for mounting on an upright post or column such as is commonly used for supporting rural mailboxes and includes a flashing strobe light and a siren which can be activated by operation of a manual switch in the residence or by operating a remote switch by a radio frequency emitter. The signal apparatus preferably includes illuminated house numbers, chimes within the residence and automatic dialing of the 911 emergency telephone number with a prerecorded message giving name, telephone number and address.

9 Claims, 9 Drawing Sheets

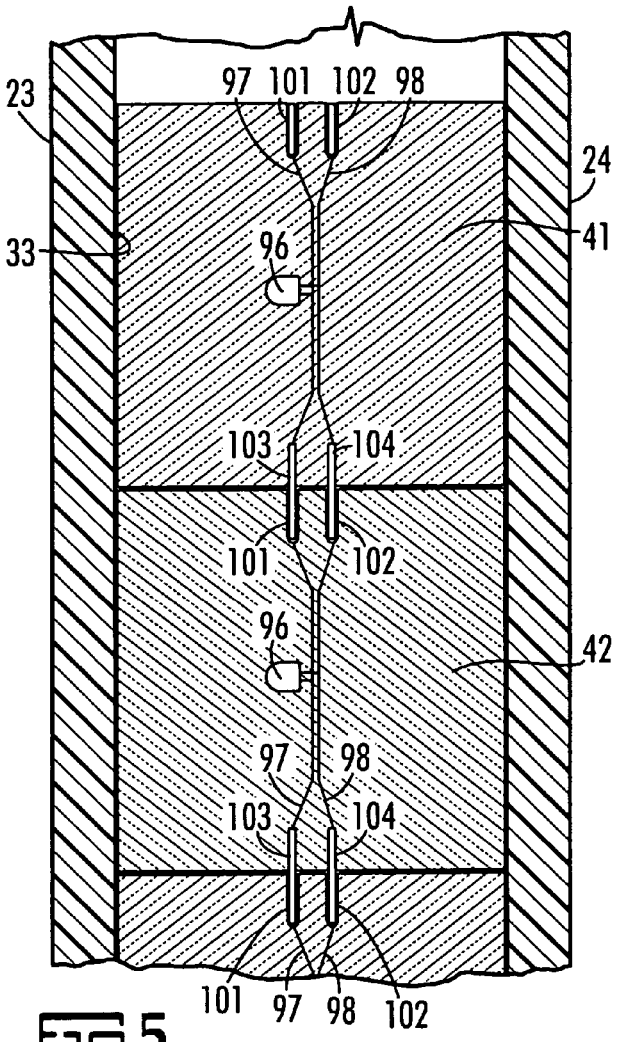
FIG.5
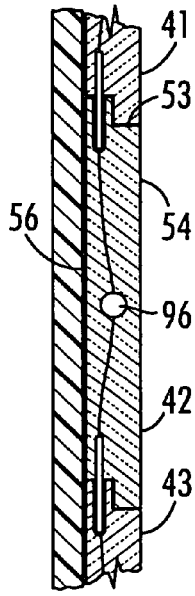
FIG.6
FIG.6A
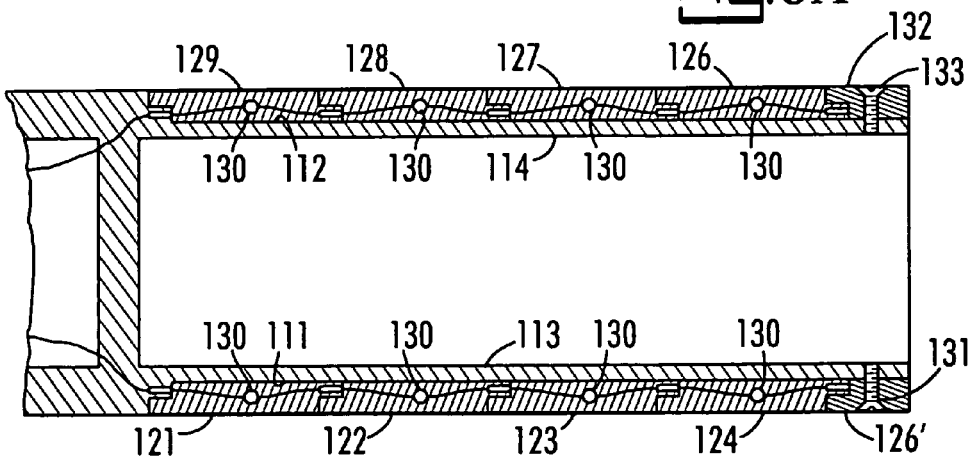

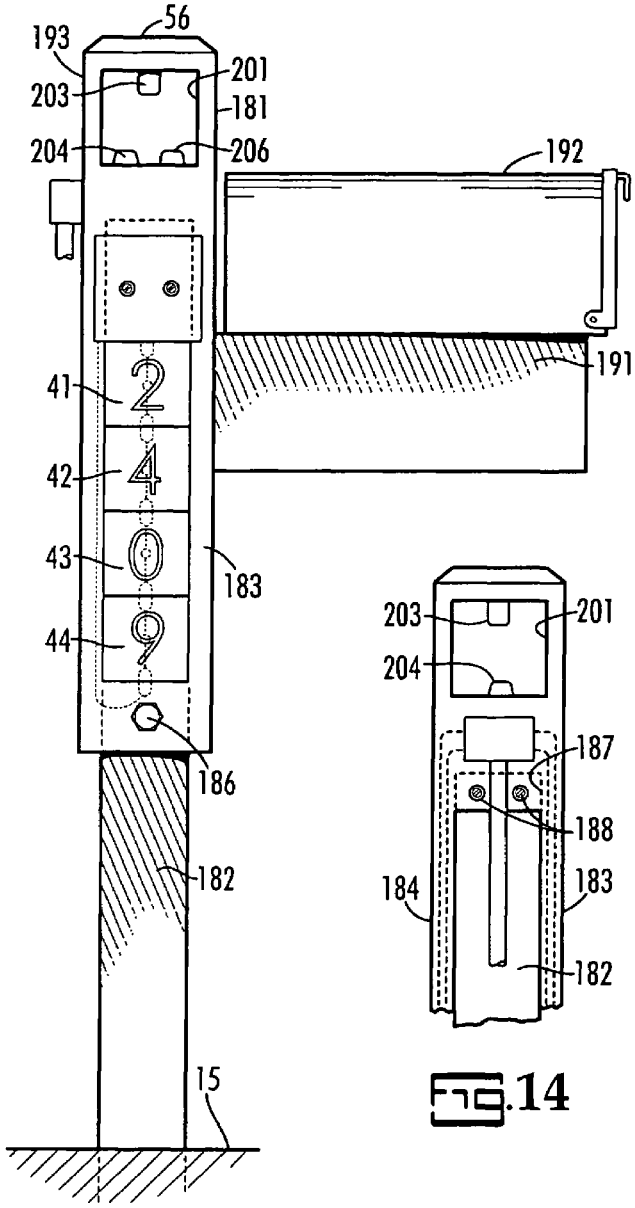
FIG.12
FIG.14
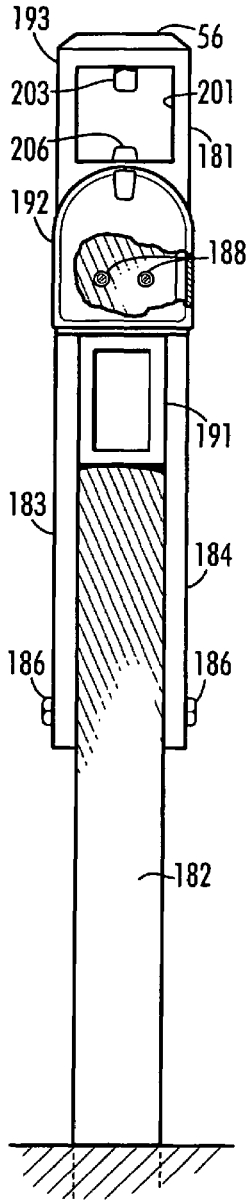
FIG.13

MAILBOX SUPPORT WITH LIGHTED RESIDENCE IDENTIFICATION AND ALERT SIGNAL APPARATUS

BACKGROUND OF THE INVENTION

House numbers are in common use for identifying residences and business locations; however, residences in rural locations, even with a house number, are often difficult and time consuming to locate. This is not only a problem for service people and occasional visitors but is of critical concern in case of emergencies, such as fire, personal injury, heart attack, robbery, etc. Help in response to a 911 call may require 15 minutes or more response and travel time of the emergency personnel and thus the help may be too late. Neighbors want to help each other in times of need; however, in an emergency they all too often do not know that help is needed until they hear the sirens or see the flashing lights of the arriving emergency crews.

SUMMARY OF THE INVENTION

The object of this invention is to not only accurately and quickly locate a residence, but is also to notify others that help is needed. This is accomplished by providing a strobe light, a siren and house number plates on a mailbox support, the house numbers being visible during the day without illumination and automatically lighted at night by suitable LED lighting. The house number lighting is preferably daylight sensitive so that it automatically turns on at time of darkness and automatically turns off during daylight. The electrical power may be provided by a solar powered 12-volt system, which includes a solar panel connected in electrical charging relation to a small 12 volt DC battery. Standard electric utility power is provided via a transformer when solar power is inadequate. The mailbox post may include a vertically extending hollow component made of a fiber composite synthetic material with a vertical tongue and groove structure on two or three sides for receiving removable sliding plates with house numbers. The lower part of the mailbox support is in the form of a sleeve or hollow component which fits over a typical four inch by four inch section wooden post set vertically in the ground. A module at the top of the hollow component includes an electricity generating solar panel delivering charging current to a 12 volt battery, windows on three or four sides, a light emitting diode (LED) providing a soft glow location light through the windows, a strobe light and a siren. The lights and siren are supplied electricity by the before-mentioned 12 volt battery or by residential utility power via a transformer in event the 12v battery is not adequately charged. Optional plates include a surveillance camera and a human presence sensor. A LED mail notification signal may be provided as an optional item. A portable control pad and/or a key pad with an emergency or panic button is designed to be carried by the resident or kept in an accessible location in the residence. Whenever the panic button is pressed a radio frequency signal causes a strobe light on the top of the mailbox support to flash and the siren to sound to notify anyone nearby that help is needed. Pressing the panic button also causes emission of a radio frequency signal that activates chimes in the residence to alert others in the residence of the emergency and causes transmission of a recorded 911 message. A manual switch is also located in the house which, upon closure, activates the strobe light, the siren, the chimes and the 911 message transmission.

BRIEF DESCRIPTION OF THE DRAWINGS

The invention is illustrated by the accompanying drawings in which:

FIG. 5 is a section taken on the line 5-5 in FIG. 4;

FIG. 6 is a section taken on line 6-6 in FIG. 1;

FIG. 6A is a section taken on line 6A-6A in FIG. 1;

FIG. 12 is a side view of a four embodiment of the invention;

FIG. 13 is a front view of the embodiment shown in FIG. 12;

FIG. 14 is a partial rear view of the embodiment shown in FIG. 12;

DETAIL DESCRIPTION OF THE INVENTION

Figure 1:
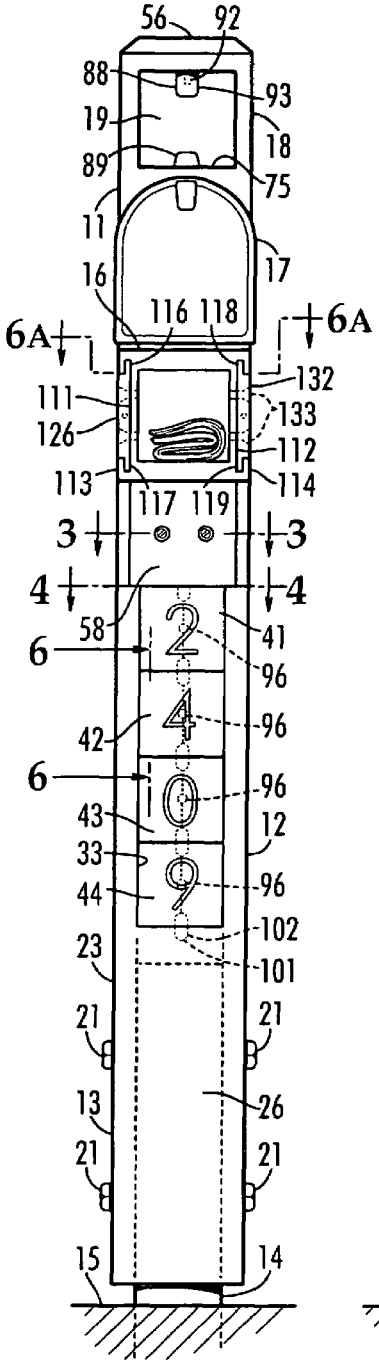
FIG. 1 is a front view of the mailbox support of a first embodiment of the invention.

FIGS. 1-8 illustrate an embodiment of the emergency alert system which includes a mailbox support 11 having a hollow square section post or column 12 which includes a lower section 13 adapted to fit over an upright mounting post 14 set securely in the ground 15. The mailbox support 11 includes a horizontally extending newspaper box 16 supporting a mailbox 17 and a housing or module 18 at its top having windows 19 in three sidewalls 23, 24, 26. The column 12 is shown secured to the post 14 by lag screws 21; however, it could be secured by a pair of locking pins to prevent unauthorized removal. The column 12 is preferably made of a suitable rigid fiber composite or synthetic material, which is resistant to damage from sunlight and atmosphere. The rear wall 22 of the column 12 is solid and the laterally opposite side walls 23, 24 and the front wall 26 have vertically elongated indentations 31, 32, 33. The indentations 31, 32, 33 have grooves in their laterally opposite sides, each set of grooves receiving tongues of four removable translucent plastic number plates 41, 42, 43, 44. As shown in FIG. 1, plates 41, 42, 43, 44 in the indentation 33 in the front wall 26 have the numbers 2, 4, 0, 9 respectively. An identical set of plates are placed in each of the indentations 31 and 32 of the side walls 23, 24.

Figure 7:
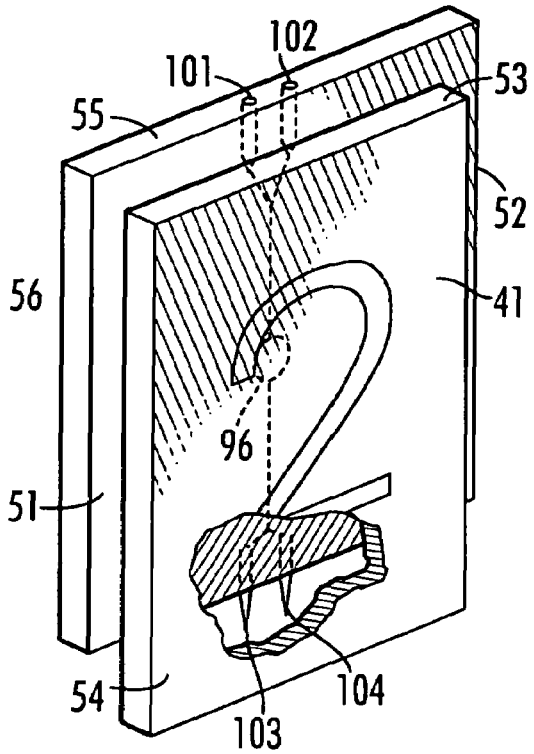
FIG. 7 is a perspective view of a number plate.
Figure 8:
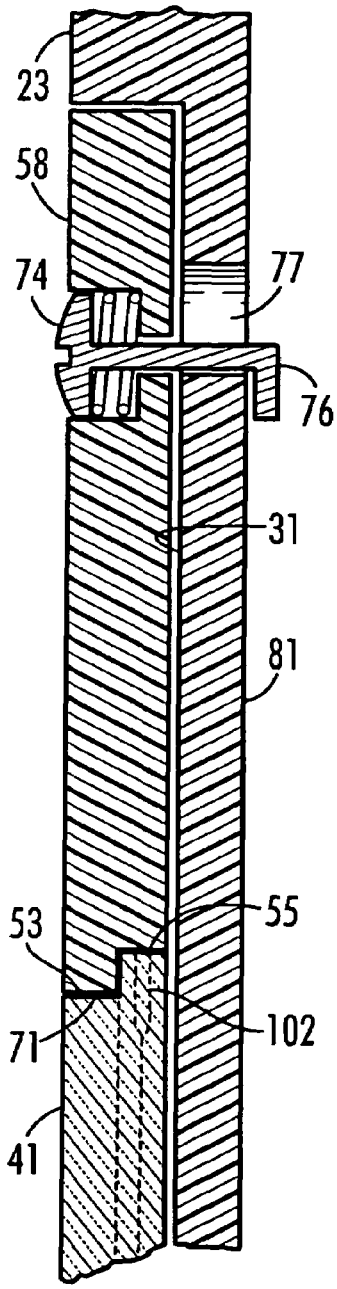
FIG. 8 is a section taken on line 8-8 in FIG. 2.

Individually, the number plates 41-44, are identical in construction except for the number embedded in or applied to the outer face of the plate. As shown in FIG. 7, the number plate 41, has a stair step construction at its top and bottom and a pair of parallel tongues or tenons 51, 52 at its laterally opposite sides. A horizontally shoulder 53 is formed at the top of a front part 54 of the number plate 41 which is below the upper end 55 of a rear part 56. The front part 54 is narrower in lateral width than the rear part 56 thus producing the tongues or tenons 51, 52 in the rear part 56. The stair step construction at the lower end of the number plate 41 results in the front part 54 extending downward from the rear part 56 the same distance that those components are vertically offset at the top of the number plate 41. A removable cover or locking plate 58 is provided at the upper end of each of the indentations 31, 32, 33 which, when removed, allows insertion of the number plates in the mortise like grooves 61, 62, 63, 64, 66, 67 formed at laterally opposites sides of the indentations 31, 32, 33. As shown in FIG. 8, the cover plate 58 has a stair step lower end providing a lip 71 extending downwardly in front of the upper end of the rear part 56 of the number plate 41 thus affording protection for the electrical connectors 101, 102 at the upper end 55 of the rear part 54 of the number plate 41. Each cover plate 58 is releasably secured to the associated one of the side walls 23, 24, 26 of the column 12 by a pair of spring loaded push connecters 74. As shown in FIG. 8, the push connector 74 has its right angle foot 76 which is passed through a slot 77 in the back wall 81 of the indentation 31 and then rotated to its illustrated locking position. Or the push connector 74 can be rotated to the locking position shown in FIG. 3, thereby releasably securing the cover plate 58*s* and the number plates 41, 42, 43, 44 in their installed positions shown in FIGS. 1 and 2.

The box shaped housing or module 18 at the top of the column 12 includes a floor 75, a light admitting or translucent window 19 in each of the front and laterally opposite side walls. An electricity producing horizontal solar panel 56 is mounted at the top of the module 18. A top light 88, a strobe light 89 and a siren 91 are mounted inside the module 18. The top light 88 may include a light emitting diode (LED) 92 and a short translucent light magnifying tube 93. The translucent panels 41, 42, 43 in the side walls of the column 12 are each illuminated by an embedded LED 96 joined in series as illustrated in FIGS. 5 and 6. The diodes 96 in the plates 41-44 are connected in series by conductors 97, 98 having a pair of sockets 101, 102 at each of their upper ends terminating flush with the upper ends of the plates 41-44, respectively, and having a pair of prongs 103, 104 extending downwardly from each of their bottom ends. The diodes 96, the conductors 97, 98 and sockets 101, 102 are embedded in the translucent plates 41-44 and the prongs 103, 104 are partially embedded in the rear part 56 of each of the plates 41-44. A pair of sockets 101, 102 are provided in the lower section 13 of the vertical column 12 for reception of the prongs 103, 104 of the plate 44 and those sockets are connected to a multiple conductor lead 105.

Figure 2:
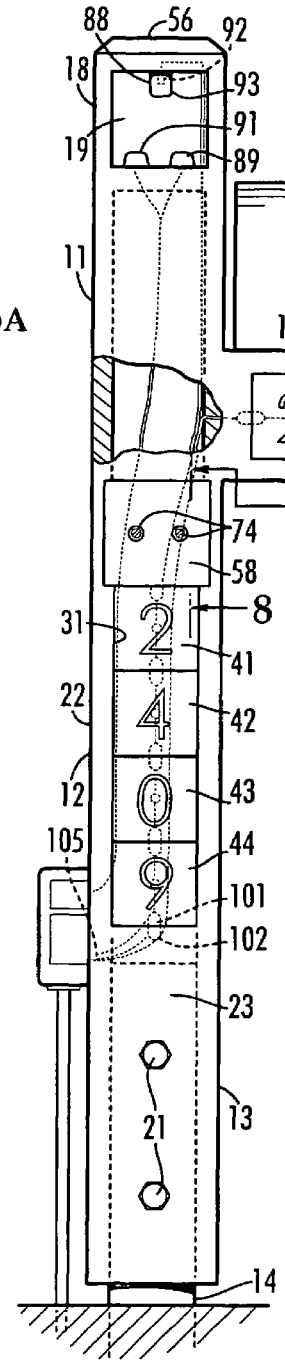
FIG. 2 is a side view of the mailbox support shown in FIG. 1.
Figure 3:
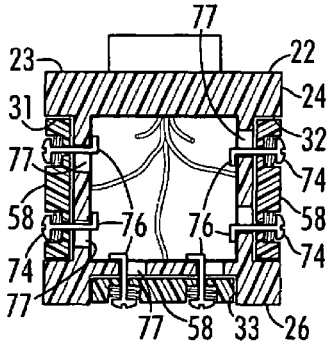
FIG. 3 is a section taken on line 3-3 in FIG. 1.
Figure 4:
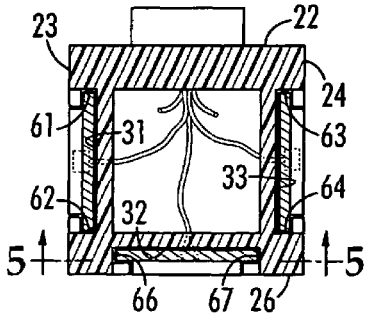
FIG. 4 is a section taken on line 4-4 in FIG. 1.

Referring to FIGS. 1, 2 and 6A, indentations 111, 112 are formed in the laterally opposite side walls 113, 114, of the newspaper box 16. As shown in FIG. 1, a pair of parallel groves 116, 117 are formed in the side wall 113 of the newspaper box 16 at the top and bottom, respectively, of the indentation 111 and a pair of parallel grooves 118, 119 are formed at the top and bottom, respectively, of the indentation 112 in the side wall 114 of the newspaper box 16. Translucent number plates 121, 122, 123, 124 each have tongues extending from their tops and bottoms, respectively, which are slidingly disposed in the parallel grooves 116, 117 and translucent plates 126, 127, 128, 129, have tongues slidingly engaged with the grooves 118, 119 in the side wall 114. The newspaper box number plates 121-124 and 126-129 are similar in construction to the post number plates 41-44 and have LED lights 130 and overlapping ends with sockets and prongs forming electrical connections for the lead wire connecting the LED lights 130 in series. The number plates 121-124 are retained in the grooves 116, 117 by a blocking plate 126' secured to the wall 113 by releasable screw type fasteners 131 and the number plates 126, 127, 128, 129 are maintained in the grooves 118, 119 by a locking plate 132 secured by fasteners 133.

Figure 9:
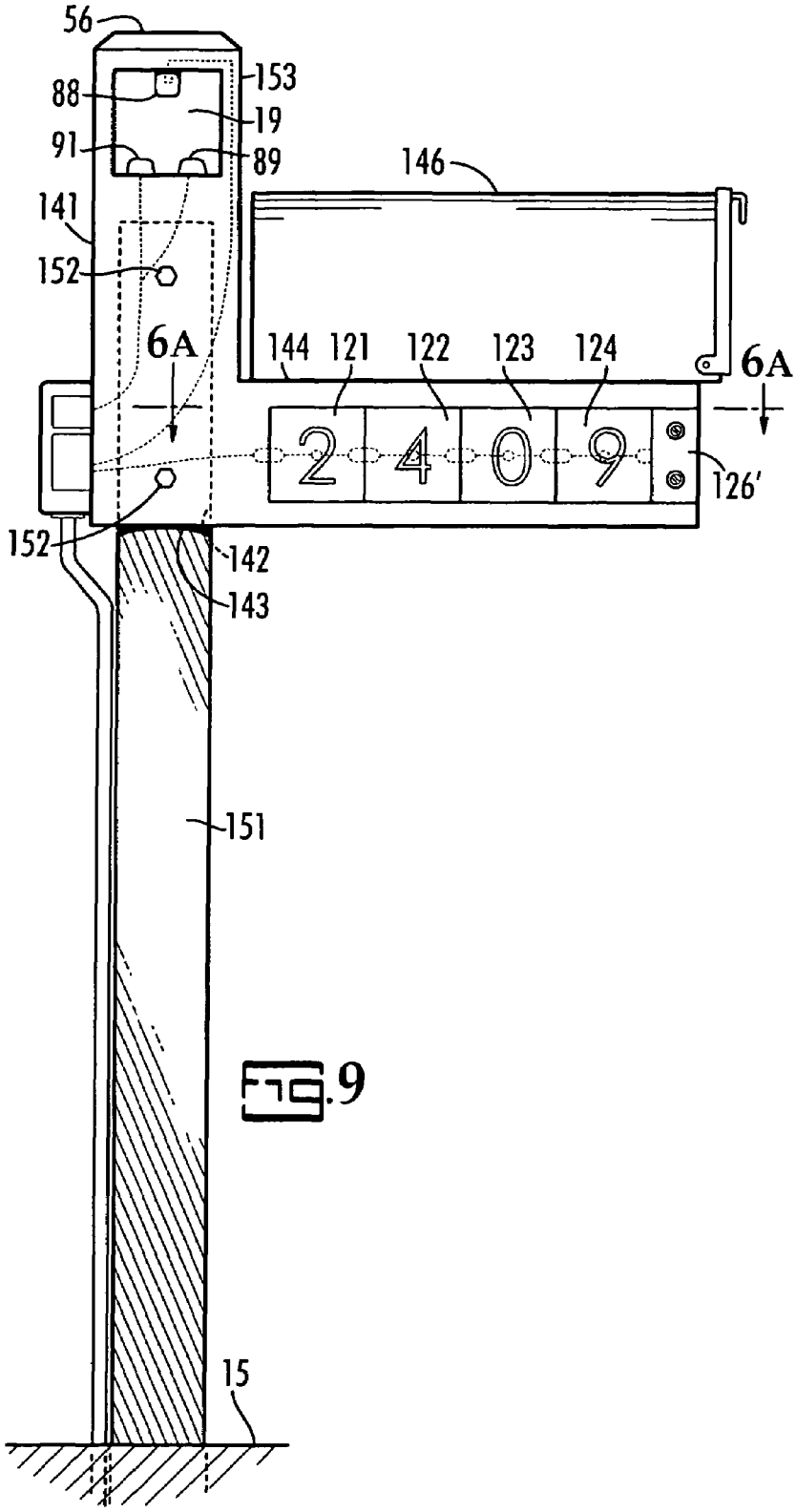
FIG. 9 is a sideview of a second embodiment of the invention.

FIG. 9 illustrates an emergency alert system with a mailbox support 141 having a four sided, square section cavity 142 extending upwardly from its bottom 143 which is at the same elevation as the bottom of a newspaper box 144 on which a conventional mailbox 146 is mounted. The support 141 is mounted on the upper end of a 4 inch by 4 inch section wood post 151, which extends into the cavity 142 and which has its lower end set in the ground 15 in a conventional manner. The support 141 is releasably secured to the post 151 by suitable fasteners such as lag screws 152. The mailbox support includes a top section 153 constructed in the same manner as the top section 18 of mailbox support 11 illustrated in FIGS. 1 and 2 and includes a solar panel 56, a top light 88, a strobe light 89, a siren 91, and windows 19 on its front and laterally opposite sides. Number plates 121, 122, 123, 124 and locking plate 126' are mounted on the newspaper box 144 in the same manner as the number plates were mounted on the newspaper box 16 of FIGS. 1 and 2. The embodiment of FIG. 9 includes the features of mailbox support 11 except it does not include the three rows of number plates on the front and laterally opposite sides of the support.

Figure 10:
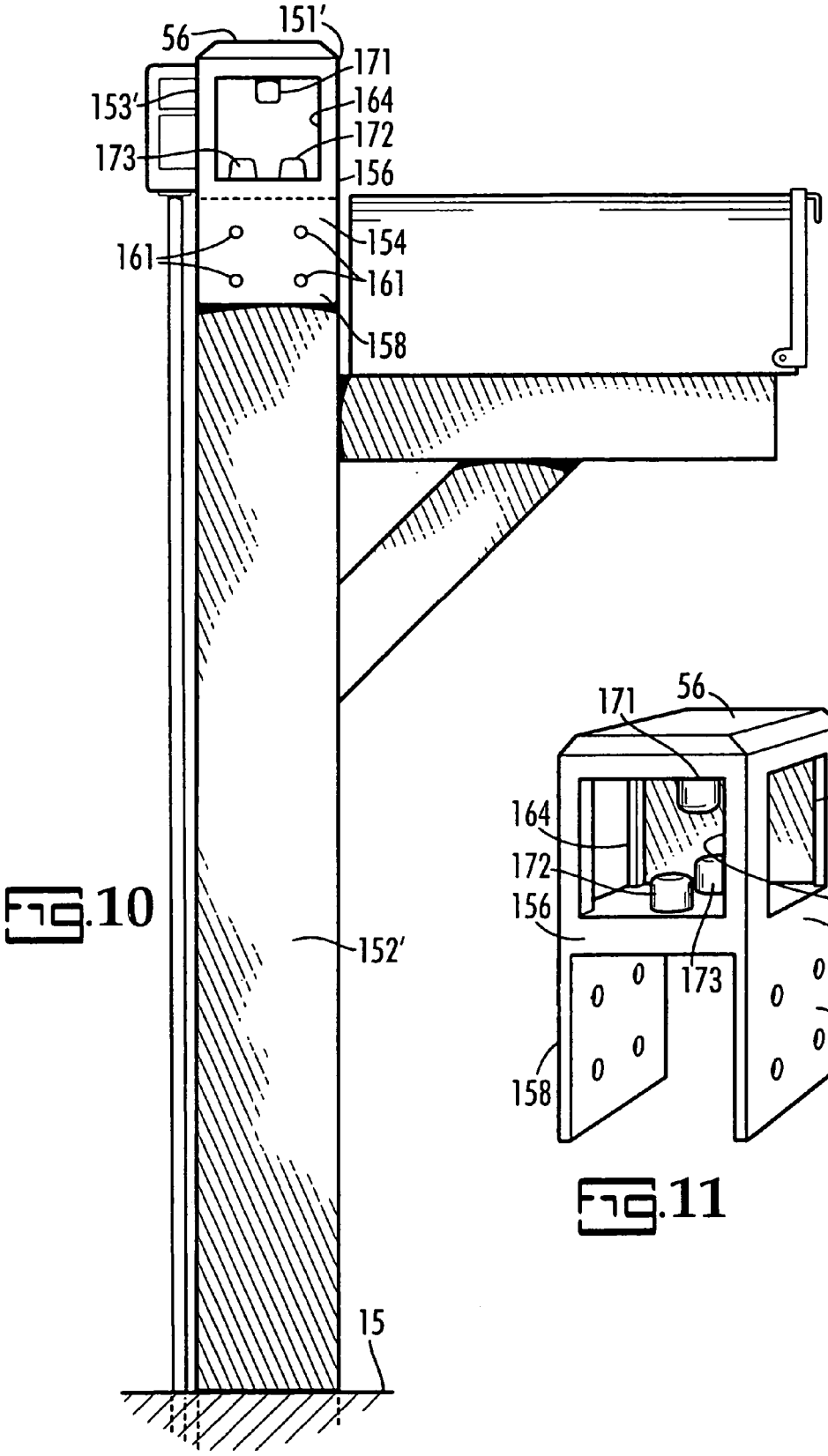
FIG. 10 is a sideview of a third embodiment of the invention.
Figure 11:
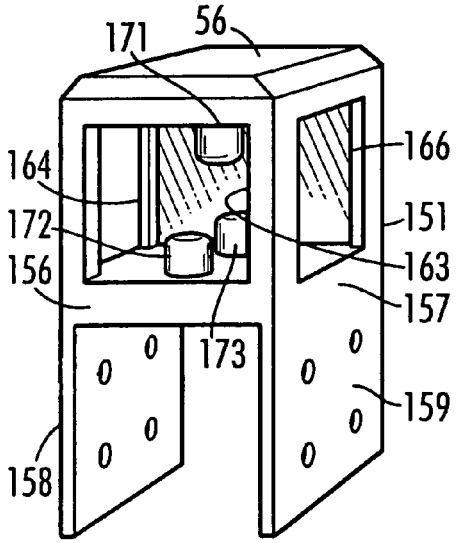
FIG. 11 is a perspective view of the embodiment shown in FIG. 10.

FIGS. 10 and 11 illustrates a signal device or attachment 151' adapted for mounting on the top of a conventional mailbox support post such as the illustrated 4 by 4 inch section wood post 152' set in the ground in a conventional manner. The signal device 151' is box shaped, having four sides 153', 154, 156, 157. The laterally opposite sides 154, 157 have mounting tabs 158, 159 extending downwardly by which the attachment 151' is secured to an upper end of the wooden post 152' by screw type fasteners 161. The signal device 151' includes a solar panel 56 on its top, windows 163, 164, 166 on the front and lateral sides, a top light 171, a strobe light 172 and a siren 173.

FIGS. 12, 13 and 14 illustrate a signal device 181 for a mailbox post 182 which includes removable number plates 41, 42, 43, 44 in each of its laterally opposite sides 183, 184. The lower ends of the laterally opposite sides 183, 184 are secured to the wood mounting post 182 by lag screws 186. The top of the post 182 extends into a downwardly open pocket 187 of the signal device 181 and is secured to the device 181 by lag screws 188. The signal device 181 is not secured to the newspaper box 191 supporting the mailbox 192. The upper portion 193 of the signal device 181 includes windows 201 on all four sides, a horizontal solar panel 56 on its top for generating electrical power, a top light 203, a strobe light 204 and a siren 206.

Figure 15:
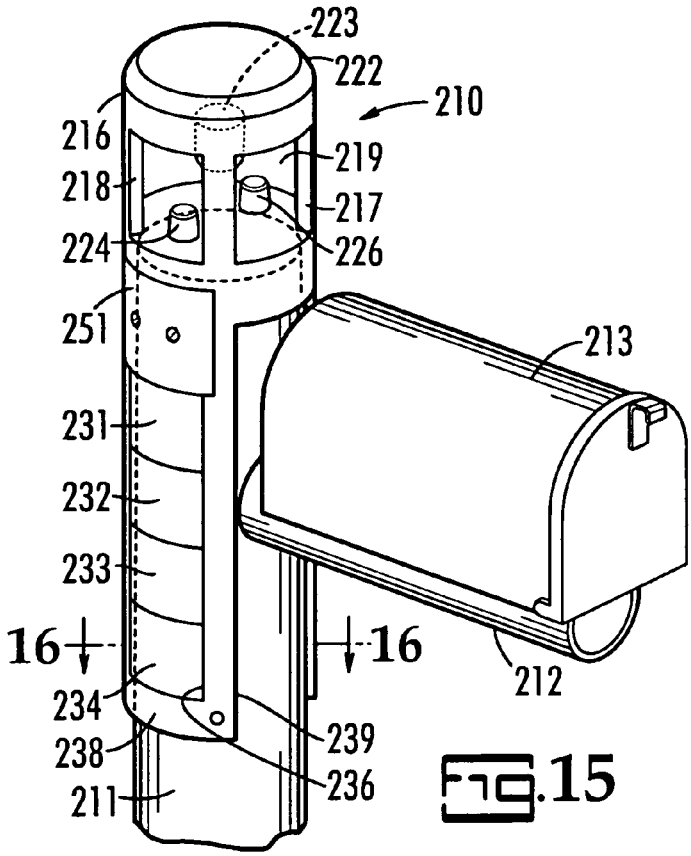
FIG. 15 is a perspective view of the fifth embodiment of the invention.
Figure 16:
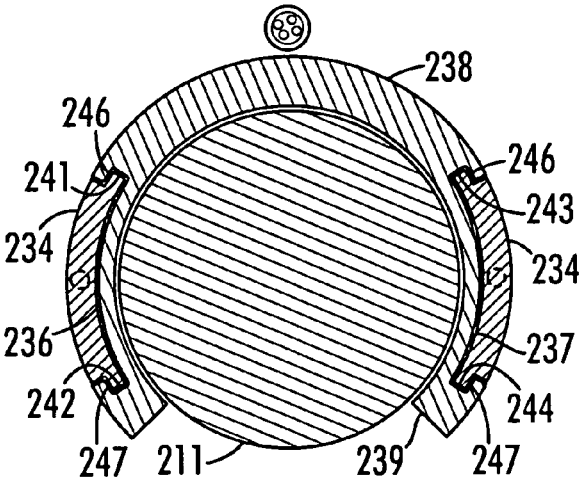
FIG. 16 is a section taken on the line 16-16 in FIG. 15.

In FIGS. 15 and 16, a cylindrically shaped signal device 210 is mounted on top of a round post 211 having a cylindrical newspaper box 212 supporting a conventional mailbox 213. The signal device 210 includes a cylindrical top portion 216 positioned on top of the post 211 which includes windows 217, 218, 219, an electric generating solar panel 222, a top light 223, a strobe light 224 and a siren 226. Curved number plates 231, 232, 233, 234 are installed in vertically extending indentations 236, 237 formed in diametrically opposite lateral sides of the cylindrically shaped wall structure 238 extending downwardly from the top portion 216. The indentation 236 includes vertically extending parallel grooves 241, 242 and the indentation 237 has vertical extending parallel grooves 243, 244 meshing with the tongues 246, 247 of number plates 231-234. Removal of releasable blocking plates 251, only one of which is shown, allows the number plates 231-234 to be installed and removed. A vertically extending gap 239 is formed in the wall structure 238 to permit installation of the signal device 210 on the post 211 with its permanently attached newspaper box 212.

Figure 17:
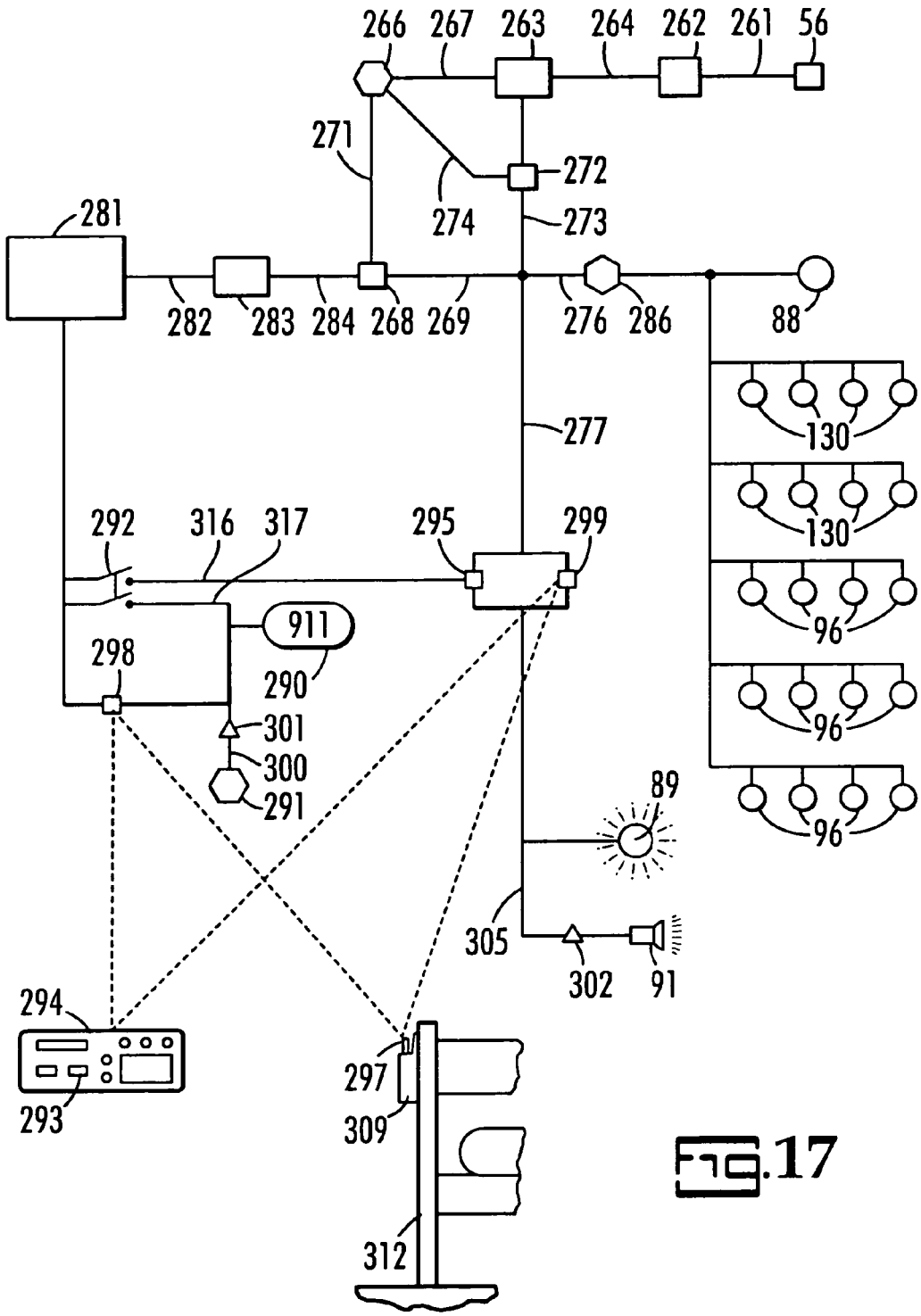
FIG. 17 is a schematic of a power supply and control system.
Figure 18:
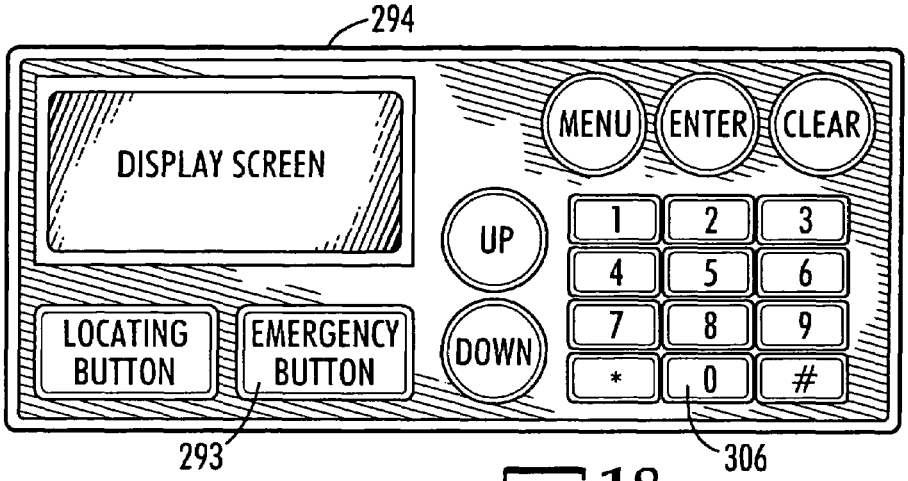
FIG. 18 shows a base monitor for the alert system of this invention.
Figure 19:
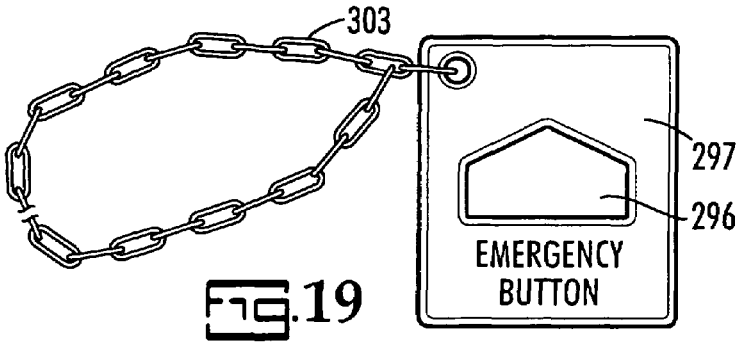
FIG. 19 shows a portable remote key pad with an emergency button.
Figure 20:
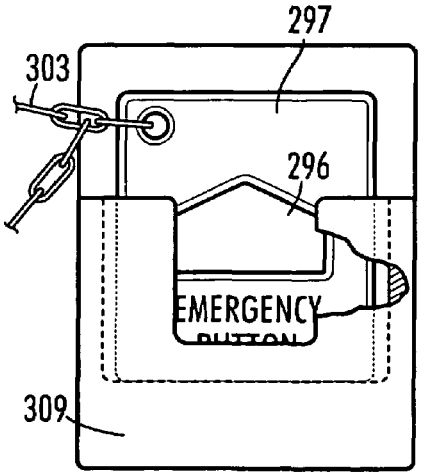
FIG. 20 shows the remote key pad in a holder.
Figure 21:
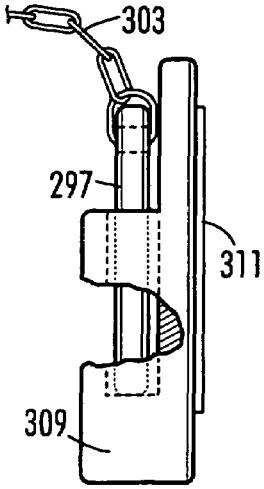
FIG. 21 is a side view of the holder shown in FIG. 20 with parts broken away for illustration purposes.

FIG. 17 shows a schematic control system for signal devices herein disclosed. The electrical generating solar panel 56 is connected by a lead 261 to a transformer 262 which in turn is connected in series to a 12 volt battery 263 by a lead 264. A voltage sensor 266 is attached to the battery 263 by a lead 267, to a switch 268 in supply lead 269 by a lead 271 and to a switch 272 in a battery output lead 273 by a lead 274. When the voltage sensor 266 senses a battery voltage below a desired operating level it opens the switch 272 in lead 273 and closes switch 268 in the supply lead 269 thereby disconnecting the battery from a supply lead 276 for the top light 88, form the LED lights 96 in the vertically arranged number plates 41-44, from the LED lights 130 in the horizontally arranged number plates on the newspaper box 16 or 144 and from the supply lead 277 for the strobe light 89 and the siren 91. Closing of the switch 268 connects a 110 volt electrical power source 281 to the supply lead 269 and leads 276, 277 branching therefrom via a lead 282, a 100/12 volt transformer 283 and lead 284. A light sensitive switch 286 opens to disconnect the LED top light 88 and the LED lights 96 and 130 in the number plates when there is daylight and closes to connect those lights to a 12v electrical source during night time thus assuring visibility of the house numbers. The strobe light 89, the siren 91, chimes 291 and a recorded 911 call device 290 are activated whenever a manual switch 292 in the residence is closed, whenever an emergency button 293 on a base monitor 294 is pressed and whenever the emergency button 296 on a remote key pad 297 is pressed. Closing the manual switch 292 electrically energizes leads 316, 317, and closes a solenoid operated switch 295 which activates the strobe light 89, the siren 91, the chimes 291 and the 911 transmission device 290. Referring also to FIGS. 18, 19, 20 and 21, pressing the emergency button 293 on the base monitor 294 or pressing the emergency button 296 on the remote key pad 297 emits a radio frequency signal causing radio frequency signal responsive switches 298, 299 to the close, thereby activating the chimes 291, the strobe light 89, the siren 91 and a 911 telephone call device 290 The prerecorded 911 message includes the resident's name, address and telephone number. A timing switch 301 in a branch lead 300 to the chimes 291 automatically opens to silence in the chimes 291 upon expiration of a predetermined time period of operation and in a like manner a timing switch 302 in branch lead 305 opens to disconnect power to the siren 91 upon passage of the predetermined time interval. The key pad 297 is preferably placed on a necklace 303 so that it may be worn by the resident and thus be readily available in event of an emergency. The keypad 297 may be kept in a pouch 309 having an adhesive layer or double sided tape 311 on its back side permitting it to be installed at a convenient location such as a bed 312. A Velcro tape connection may be preferred.

Once the alert system has been activated by pressing the emergency button 293 on the base monitor 294 or the emergency button 296 on the key pad 297, the alert system can only be deactivated by entering a shut off code into the base monitor 294 by using its numbered pad 306.

What is claimed is:

1. An emergency signal apparatus for a residence attachable to an upright support, comprising:

a housing at the top of said support including a horizontal solar panel supplying electrical power on top of said housing, a floor, side walls forming a room including a pair of oppositely disposed side walls, and a window in each of said oppositely disposed side walls, downward extensions on said oppositely disposed side walls adapted for rigid connection to said support, a strobe light supported by said housing, a siren supported by said housing, a low voltage battery in said housing for delivering low voltage electric power, said battery being connected in electrical charge receiving relation to said solar panel, a first circuit connecting said strobe light and siren to said battery including a radio frequency operated switch having on and off conditions of adjustment and a solenoid operated switch having open and closed positions of adjustment, said switches being in parallel relation to one another in said first circuit, a source of high voltage electrical power, a second electrical circuit interconnecting said high voltage electrical power and a part of said first circuit upstream of said radio frequency operated switch and said solenoid operated switch, a transformer in said second circuit converting said high voltage electric power to said low voltage electrical power, a first sensor operated switch in said second circuit between said transformer and the connection of said second circuit to said part of said first circuit, a second sensor operated switch in said first circuit between said battery and the connection of said second circuit with said first circuit, and a charge condition sensor connected in signal receiving relation with said battery and in signal delivery relation with said sensor operated switches, said sensor operated switches operating to connect said first circuit only to said battery when said sensor senses a predetermined high battery charge condition and operating to only connect said transformer to said first circuit when said sensor senses a predetermined low battery discharged condition.

2. The signal apparatus of claim 1 wherein said downward extensions of said oppositely disposed side walls each include a vertically elongated indentation having a pair of parallel grooves in their laterally opposite sides opening toward one another, and including a plurality of quadrilateral shaped plastic plates positioned end to end and each having a pair of laterally spaced tongues extending into and guided by said grooves, respectively, said plates being translucent and each including an embedded LED light and a clearly visible number, said lights being connected to said first circuit.

3. The signal apparatus of claim 2 having a newspaper box extending horizontally from said downward extensions of said side walls, said newspaper box having laterally opposite walls each of which has a horizontally elongated indentation including top and bottom parallel grooves opening toward one another and further comprising a plurality of quadrilateral shaped plastic plates positioned end to end and each having a pair of upper and lower tongues extending into and guided by said grooves, respectively, said plates being translucent and each including a clearly visible number and an embedded LED light connected to said first circuit.

4. The signal apparatus of claim 1 having a newspaper box extending horizontally from said downward extensions of said side walls, said newspaper box having laterally opposite walls each with a horizontally elongated indentation including top and bottom parallel grooves opening toward one another and further comprising a plurality of quadrilateral shaped plastic plates positioned end to end and each having upper lower tongues extending into and guided by said grooves, respectively, said plates being translucent and each including a clearly visible number and a LED light connected to said first circuit.

5. The signal apparatus of claim 1 including chimes connected to a source of electricity by a circuit including a normally open radio frequency signal responsive switch and a timer switch connected in series, said timer switch automatically terminating power to said chimes upon a predetermined time period of operation.

6. The signal apparatus of claim 1 including a key pad with an emergency button which when pressed transmit a radio frequency signal closing said radio frequency operated switch.

7. The signal apparatus of claim 1 including a top light in said housing connected to said first circuit through a daylight sensitive switch which is automatically open during daylight and closed during darkness.

8. The signal apparatus of claim 1 wherein said first circuit includes a branch lead connected to said siren, said branch lead including a timer switch which automatically opens to disconnect power to said siren at the end of a predetermined time interval of its sounding operation thereby terminating its audible performance.

9. The signal apparatus of claim 1 including automatic telephone transmission of a prerecorded 911 message giving name, address and telephone number of the resident of said residence.

* * * * *